United States Patent [19]

Picard

[11] 4,350,067

[45] Sep. 21, 1982

[54] CHAIN SAW SUPPORT APPARATUS

[76] Inventor: George E. Picard, 418 Depot St., South Easton, Mass. 02375

[21] Appl. No.: 261,007

[22] Filed: May 6, 1981

[51] Int. Cl.[3] ..... B27B 17/02

[52] U.S. Cl. ..... 83/796; 83/574; 269/296

[58] Field of Search ..... 83/796, 574, 798; 269/296

[56] References Cited

U.S. PATENT DOCUMENTS

| | | | |
|---|---|---|---|
| 3,053,290 | 9/1962 | Fitzgerald | 269/296 |
| 4,127,046 | 11/1978 | Jackson | 83/798 |
| 4,210,049 | 7/1980 | Gauthier | 83/796 |
| 4,214,498 | 7/1980 | Zukas et al. | 83/796 |
| 4,307,640 | 12/1981 | Michael | 83/574 |

*Primary Examiner*—Donald R. Schran

[57] ABSTRACT

Chain saw support apparatus is disclosed for supporting and counterbalancing a portable power chain saw so that it may easily be manually swung by its handle between raised and lowered positions for cutting of a log or the like supported therebeneath.

6 Claims, 4 Drawing Figures

CHAIN SAW SUPPORT APPARATUS

This invention relates to portable power chain saw support apparatus for supporting and counterbalancing a portable power chain saw so that it may be easily be manually swung by its handle between raised and lowered positions for cutting of a log or the like supported therebeneath.

Portable power chain saws are well known in the prior art, for they have been used for several decades not only by professional lumberjacks but also by amateurs.

A major disadvantage in the use of such chain saws is in the likelihood of serious injury to the operator, due to their tendency to get out of control while running.

Another disadvantage of such chain saws is their weight, since even the new and lighter chain saws inevitably fatigue the operator after long and repeated use.

A variety of support apparatus have heretofore been used in attempts to alleviate these problems. For example, Niemela et al., U.S. Pat. No. 4,123,957, and Jackson, U.S. Pat. No. 4,127,046, show chain saws mounted on working platforms. However, the chain saw support apparatus disclosed in these patents are deficient in that they are complicated, cumbersome and difficult to transport to remote working sites.

Accordingly, in view of such deficiencies of the prior art, it is a major object of the present invention to provide chain saw support apparatus which may readily be mounted on a fixed support and hence is much safer to use.

It is another object of the present invention to provide portable chain saw support apparatus of simple construction which can readily be assembled and disassembled so that it can easily be moved to remote sites.

In order to accomplish the above and still further objects, the present invention provides, for use with a support structure having a horizontally extending supporting pin for supporting for operation a portable power chain saw pivotally mounted thereon and having at one end a power unit including a handle, a motor and motor controls, and, extending from said power unit, a rigid chain saw bar having a free end and carrying around its periphery for movement in a vertical operating plane, a plurality of movable saw teeth driven by the motor, chain saw support apparatus for supporting the chain saw for vertical swinging movement in its operating plane around said horizontal supporting pin.

The support apparatus of the invention comprises a rigid lever arm extending perpendicularly to the supporting pin and having, between its opposite ends, fulcrum means for receiving the free end of the horizontal supporting pin for supporting the lever arm for vertical swinging movement in the operating plane, longitudinally spaced suspension means on said lever arm between the fulcrum means and one end of the lever arm for removably suspending the chain saw bar beneath the lever arm with the chain saw bar extending in a direction toward the fulcrum means with its free end spaced therefrom toward said one end for bodily vertical swinging movement of the chain saw in the operating plane, and counterweight means mounted on the lever arm between the fulcrum means and the other end of the lever arm for counterbalancing the weight of the chain saw power unit.

With this arrangement, the supported and counterbalanced chain saw may easily be manually swung by its handle between raised and lowered positions for cutting a workpiece supported therebeneath.

If desired, there may also be provided workpiece support means having a longitudinal axis for supporting a workpiece beneath the chain saw bar, and the chain saw support means may be mounted on the workpiece support means by means of a horizontally extending supporting pin parallel to the workpiece axis and spaced above and laterally displaced from the workpiece support means axis for supporting the chain saw above the workpiece for vertical swinging movement in its operating plane around the horizontal supporting pin.

Other objects, features, and advantages of the present invention will appear from the following detailed description of a preferred embodiment thereof, taken together with the accompanying drawings, wherein.

Figure 1:
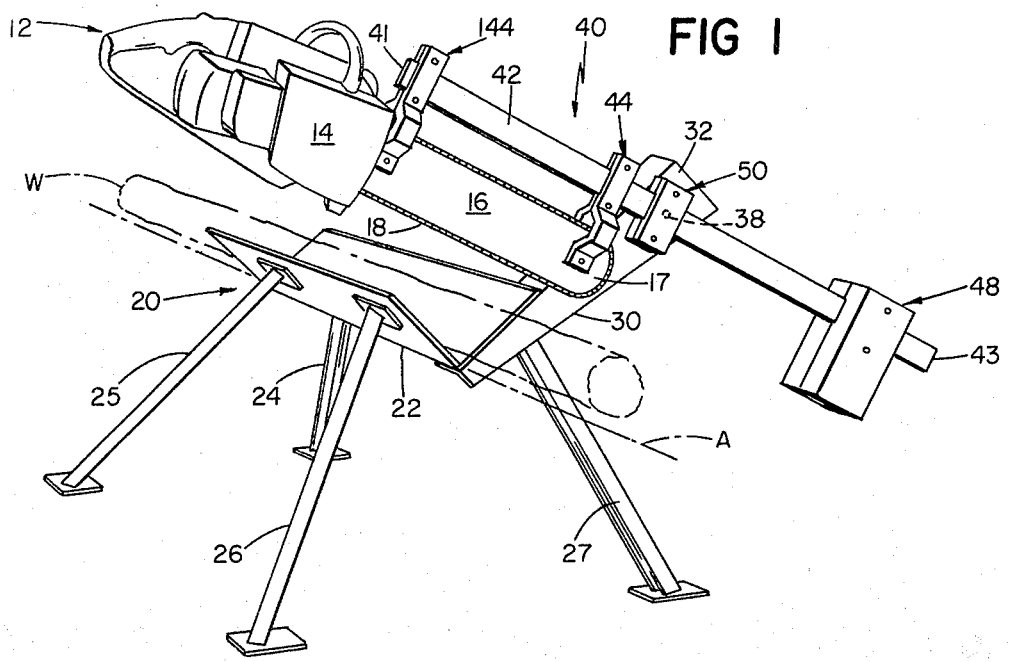
FIG. 1 is a isometric view of the chain saw support apparatus of the present invention mounted on a support member.
Figure 2:
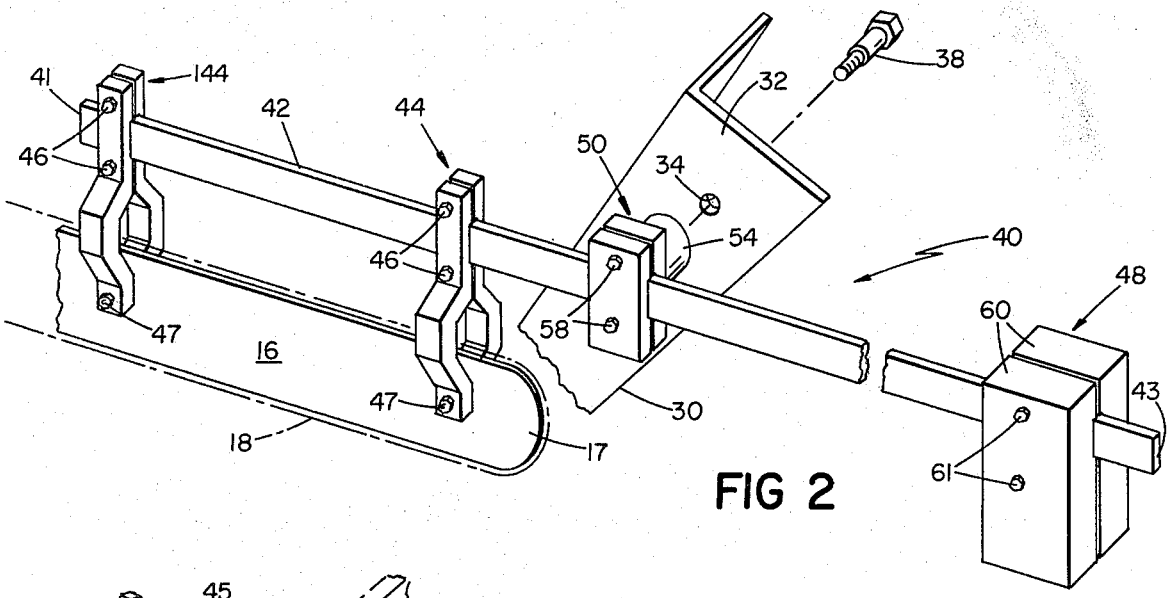
FIG. 2 is an enlarged isometric view of a portion of the apparatus of FIG. 1.

Referring to the drawings, the chain saw support apparatus of the present invention, generally designated 40 and best shown in FIG. 2, is shown mounted on a support structure, generally designated 20 and shown in FIG. 1, fur cutting a workpiece W supported thereon by vertical swinging movement of a conventional portable power chain saw, generally designated 12, mounted thereon. Chain saw 12 has at one end a power unit 14, including a handle, a motor and suitable motor controls and, extending from its power unit 14, a rigid chain saw bar 16 having a free end 17 and carrying around its periphery, for movement in a vertical operating plane defined by the plane of chain saw bar 16, a plurality of movable saw teeth 18 which are driven by its motor.

More specifically, support structure 20 includes workpiece support trough 22 having a longitudinal axis A for supporting a workpiece W beneath chain saw bar 16. Trough 22 is supported at a suitable distance above the ground by four legs 24, 25, 26 and 27. A chain saw support bracket 30 is mounted on workpiece support trough 22, with its free end 32 and bore 34 therein spaced above and laterally displaced from axis A for supporting chain saw 12 for vertical swinging movement in its operating plane. For this purpose, there is provided a horizontally extending supporting pin 38 extending through bracket bore 34, with its axis parallel to workpiece support axis A and spaced above and laterally displaced from said workpiece support trough axis A.

For supporting chain saw 12 above the workpiece W for vertical swinging movement in the chain saw operating plane around pin 38, there is provided a rigid lever arm 42 extending perpendicularly to workpiece support axis A and pin 38. Mounted on lever arm 42, between its opposite ends 41 and 43, is a fulcrum block, generally designated 50, for receiving the threaded end of horizontal supporting pin 38 for pivotally supporting lever arm 42 for vertical swinging movement in its operating plane. A pair of longitudinally spaced, downwardly transversely extending suspension clamps 44 and 144 are adjustably mounted on arm 42 between fulcrum block 50 and one end 41 of lever arm 42 for removably suspending chain saw bar 16 therebeneath with the chain saw power unit 14 on the opposite side of workpiece support trough axis A from fulcrum block 50 and with chain saw bar 16 extending in a direction toward fulcrum block 50 with its free end 17 spaced between fulcrum block 50 and workpiece support axis A for bodily vertical swinging movement of chain saw 12 in its operating plane. A counterweight assembly, generally designated 48, is also adjustably mounted on lever arm 42 between fulcrum block 50 and the other end 43 of lever arm 42 for counterbalancing the weight of chain saw power unit 14.

Figure 3:
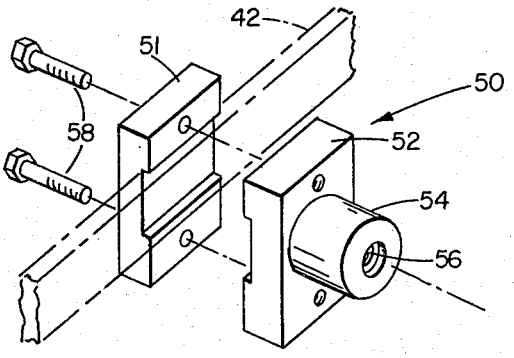

More specifically, fulcrum block 50, as shown in FIG. 3, includes a pair of opposing elements 51 and 52 which are clamped together on opposite sides of lever arm 42 by a pair of bolts 58 at any desired position on lever arm 42. Element 52 has a horizontally extending lug 54 with a threaded bore 56 for receiving the threaded end of pin 38 to support lever arm 42 for vertical swinging movement.

Figure 4:
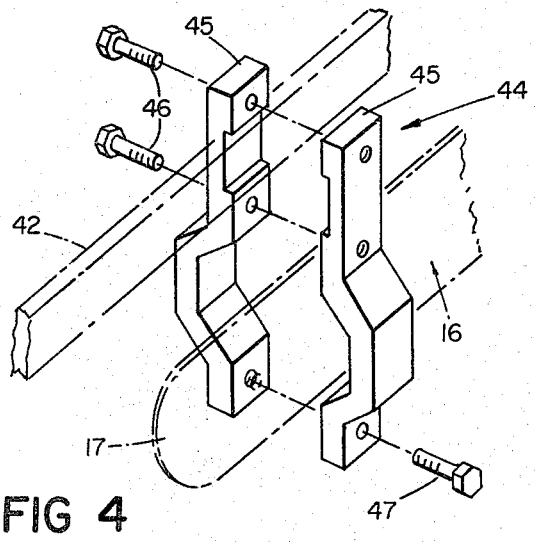
FIGS. 3 and 4 are enlarged, exploded, detail isometric views of portions of the apparatus of FIGS. 1 and 2.

Suspension clamps 44 and 144, as best shown in FIG. 4, each includes a pair of identical opposing elements 45 which are clamped together on opposite sides of lever arm 42 by a pair of bolts 46. The lower ends of clamps 44 and 144 are fixedly attached to chain saw bar 16 by bolts 47 which extend through bores (not shown) in chain saw bar 16. The points of attachment of clamps 44 and 144 may be adjusted as desired to compensate for the length of chain saw bar 16.

Counterweight assembly 48, as best shown in FIG. 2, also has a pair of identical opposing elements 60 which are clamped together on opposite sides of lever arm 42 by a pair of bolts 61 for adjustable mounting therealong to a position at which chain saw 12 is counterbalanced as desired.

The chain saw support apparatus 40 of the invention may be readily transported to a remote work site and, for this purpose, may be quickly disassembled and reassembled simply by removing its supporting pin 38 so that it may be broken down into two easily transported sections. In use, a workpiece W, such as a log, board and the like to be cut by chain saw 12 may be placed on workpiece support trough 22 and easily and safely cut by manually swinging the counterbalanced chain saw 12 supported above workpiece W for bodily movement thereof in its operating plane between its raised and lowered positions.

For some uses, the support structure may largely be omitted and the chain saw support apparatus of the invention temporarily supported by any convenient tree trunk, post or the like, by means of a horizontally extending supporting pin fixed therein to function as does supporting pin 38 of the preferred embodiment.

Further modifications of the invention, within the spirit thereof and the scope of the appended claims, will occur to those skilled in the art.

What is claimed is:

1. For use with a support structure having a horizontally extending supporting pin for supporting for operation a portable power chain saw having at one end a power unit including a handle, a motor and motor controls, and, extending from said power unit, a rigid chain saw bar having a free end and carrying around its periphery for movement in a vertical operating plane, a plurality of movable saw teeth driven by said motor chain saw support apparatus for supporting said chain saw by said support structure for vertical swinging movement in said operating plane around said horizontal supporting pin said support apparatus comprising a rigid lever arm extending perpendicularly to said supporting pin and having, between its opposite ends, fulcrum means for receiving said horizontal supporting pin for supporting said lever arm for vertical swinging movement in said operating plane suspension means on said lever arm between said fulcrum means and one end of said lever arm for removably suspending said chain saw bar beneath said lever arm with said chain saw bar extending in a direction toward said fulcrum means with its free end spaced therefrom toward said one end for bodily vertical swinging movement of said chain saw in said operating plane, and counterweight means mounted on said lever arm between said fulcrum means and the other end of said lever arm for counterbalancing the weight of said chain saw power unit, whereby said supported and counterbalanced chain saw may easily be manually swung by its handle between raised and lowered positions for cutting of a workpiece supported therebeneath.

2. Chain saw support apparatus as claimed in claim 1, further including workpiece support means having a longitudinal axis for supporting a workpiece beneath said chain saw bar, and chain saw support means mounted on said workpiece support means, said chain saw support means having a horizontally extending supporting pin parallel to said workpiece axis and spaced above and laterally displaced from said workpiece support means axis for supporting said chain saw above said workpiece for vertical swinging movement in said operating plane around said horizontal supporting pin.

3. Chain saw support apparatus for cutting a workpiece supported thereon by vertical swinging movement of a portable power chain saw mounted thereon, said chain saw having at one end a power unit including a handle, a motor and motor controls, and, extending from said power unit, a rigid chain saw bar having a free end and carrying around its periphery for movement in a vertical operating plane, a plurality of movable saw teeth driven by said motor, said apparatus comprising, workpiece support means having a longitudinal axis for supporting a workpiece beneath said chain saw bar chain saw support means mounted on said workpiece support means, said chain saw support means having a horizontally extending supporting pin parallel to said workpiece axis and spaced above and laterally displaced from said workpiece support means axis for supporting said chain saw above said workpiece for vertical swinging movement in said operating plane around said horizontal supporting pin a rigid lever arm extending perpendicularly to said workpiece support means axis and said pin and having, between its opposite ends, fulcrum means for receiving the free end of said horizontal supporting pin for pivotally supporting said lever arm for said vertical swinging movement in said operating plane suspension means on said lever arm between said fulcrum means and one end of said lever arm for removably suspending said chain saw bar beneath said lever arm with said chain saw power unit on the opposite side of said workpiece axis from said fulcrum means and said chain saw bar extending in a direction toward said fulcrum means with its free end spaced between said fulcrum means and said workpiece axis for bodily vertical swinging movement of said chain saw in said operating plane, and counterweight means mounted on said lever arm between said fulcrum means and the other end of said lever arm for counterbalancing the weight of said chain saw power unit, whereby said supported and counterbalanced chain saw may easily be manually swung by its handle between raised and lowered positions for cutting of a workpiece supported therebeneath.

4. Chain saw operating apparatus as claimed in claim 1 or 3, wherein said counterweight means is mounted on said lever arm for adjustable movement therealong.

5. Chain saw support apparatus as claimed in claim 1 or 3, wherein said suspension means is mounted on said lever arm for adjustable movement therealong.

6. Chain saw support apparatus as claimed in claim 5, wherein said suspension means includes a pair of longitudinally spaced clamp means transversely mounted on said lever arm.

* * * * *